US009719290B1

(12) United States Patent
Arroyo

(10) Patent No.: US 9,719,290 B1
(45) Date of Patent: Aug. 1, 2017

(54) GARAGE DOOR ACCESSORY

(71) Applicant: Robert Francis Arroyo, Kingsburg, CA (US)

(72) Inventor: Robert Francis Arroyo, Kingsburg, CA (US)

( * ) Notice: Subject to any disclaimer, the term of this patent is extended or adjusted under 35 U.S.C. 154(b) by 0 days.

(21) Appl. No.: 15/092,276

(22) Filed: Apr. 6, 2016

Related U.S. Application Data

(60) Provisional application No. 62/207,093, filed on Aug. 19, 2015.

(51) Int. Cl.

| | |
|---|---|
| ***E06B 3/48*** | (2006.01) |
| ***E06B 7/02*** | (2006.01) |
| ***E05D 13/00*** | (2006.01) |
| ***E06B 9/02*** | (2006.01) |
| *E06B 3/70* | (2006.01) |

(52) U.S. Cl.
CPC ..... *E06B 7/02* (2013.01); *E05D 13/00* (2013.01); *E06B 9/02* (2013.01); *E05Y 2900/106* (2013.01); *E06B 2003/7044* (2013.01)

(58) Field of Classification Search
CPC ..... E06B 7/02; E06B 7/04; E06B 9/02; E06B 2003/7044
USPC ..... 160/113, 115, 116
See application file for complete search history.

(56) References Cited

U.S. PATENT DOCUMENTS 1,555,308 A * 9/1925 Morgan ..... E06B 9/52 160/92
2,629,435 A * 2/1953 Dadswell ..... E05F 13/02 16/DIG. 7
3,263,734 A * 8/1966 Lister ..... B61D 19/002 160/113
4,231,412 A * 11/1980 Nowak ..... E06B 9/52 160/113
4,378,043 A 3/1983 Sorenson
4,653,566 A * 3/1987 Miale ..... E06B 9/54 160/113
4,676,293 A * 6/1987 Hanssen ..... E05D 15/24 160/201
4,770,087 A 9/1988 Danley et al.
5,584,333 A * 12/1996 Torchetti ..... E06B 3/485 160/201
5,611,382 A * 3/1997 Sferra ..... E06B 9/52 160/113
5,720,332 A * 2/1998 Nachreiner ..... E06B 9/581 160/201
5,727,614 A * 3/1998 Lichy ..... E06B 9/581 160/201
5,848,630 A * 12/1998 Manzo ..... E05B 65/0021 160/113
5,860,465 A * 1/1999 Eastridge ..... E06B 3/485 160/113
5,904,199 A * 5/1999 Messner ..... E06B 7/03 160/127
6,092,580 A 7/2000 Lucas
(Continued)

*Primary Examiner* — Katherine Mitchell
*Assistant Examiner* — Johnnie A Shablack
(74) *Attorney, Agent, or Firm* — Plager Schack LLP

(57) ABSTRACT

A garage door accessory is configured to increase ventilation into a garage. The garage door accessory includes at least one panel frame attached to at least one panel grate. At least one stow bar is attached to the panel frame. A lock assembly is attached to the panel grate and the panel frame; wherein the lock assembly further comprises a lock bar.

3 Claims, 4 Drawing Sheets

(56) References Cited

U.S. PATENT DOCUMENTS 6,315,027 B1 * 11/2001 Lichy ..... E05D 15/165 16/271
6,415,844 B1 * 7/2002 Smith ..... E06B 9/52 160/216
6,463,988 B1 * 10/2002 Mullet ..... E05D 15/165 160/201
6,557,614 B1 * 5/2003 Lampers ..... E06B 9/52 160/113
6,679,310 B2 * 1/2004 De Zen ..... E05D 15/242 160/229.1
6,715,527 B2 4/2004 Ardoin
6,810,938 B2 * 11/2004 Aquilina ..... E05D 1/04 16/355
6,883,578 B2 * 4/2005 Whitley ..... E05D 7/1077 16/225
6,955,206 B2 * 10/2005 Mullet ..... E05D 15/165 160/193
7,040,373 B2 * 5/2006 Snyder ..... E06B 3/7005 160/113
7,121,317 B2 * 10/2006 Mullet ..... E05D 15/24 160/201
7,143,803 B2 * 12/2006 Mitchell ..... E06B 7/02 160/113
7,308,926 B1 * 12/2007 Hawkins ..... E05B 65/0021 160/113
7,484,286 B2 2/2009 Fowler
7,509,990 B1 * 3/2009 Milligan ..... E06B 9/24 160/113
7,726,378 B1 * 6/2010 Savon ..... E06B 3/485 16/258
8,651,165 B2 * 2/2014 Huynh ..... E05B 17/0058 160/205
2004/0144499 A1 * 7/2004 Pannell ..... E06B 9/52 160/113
2008/0230188 A1 * 9/2008 Albert ..... E06B 3/927 160/113
2009/0084507 A1 4/2009 Tescher
2013/0292067 A1 11/2013 Lucas
2014/0311039 A1 10/2014 Ardaiz
2016/0145861 A1 * 5/2016 Wexler ..... E06B 9/02 52/202
2016/0290037 A1 * 10/2016 Amsellem ..... E06B 7/02

* cited by examiner

1/4

GARAGE DOOR ACCESSORY

RELATED APPLICATION

This application claims priority to provisional patent application U.S. Ser. No. 62/207,093 filed on Aug. 19, 2015, the entire contents of which is herein incorporated by reference.

BACKGROUND

The embodiments herein relate generally to garage door systems.

Prior to the embodiments of the disclosed invention, there was no good way to permit ventilation of a garage while keeping animals, insects and intruders out. Embodiments of the disclosed invention solve this problem.

SUMMARY

A garage door accessory is configured to increase ventilation into a garage. The garage door accessory includes at least one panel frame attached to at least one panel grate. At least one stow bar is attached to the panel frame. A lock assembly is attached to the panel grate and the panel frame. The lock assembly further comprises a lock bar.

In some embodiments, a garage wheel bracket can be attached to a garage door wheel axle. A garage door wheel can be attached to a distal end of the garage door wheel axle. An extension can be attached to the garage door wheel axle and a first hinge bar. A bar bracket can be attached to the first hinge bar and a second hinge bar. In some embodiments, a threaded rod can be fit through the first hinge bar and attached to the first hinge bar with a lower adjustment fastener and an upper adjustment fastener.

In some embodiments, a garage door can comprise a first panel and a second panel. A first panel frame first stow bracket and first panel frame second stow bracket can be attached to the first panel on the garage door. A second panel frame first stow bracket and second panel frame second stow bracket can be attached to the second panel on the garage door. In some embodiments, a hinge can be attached to the first panel frame and the second panel frame wherein the first panel frame can be folded against the second panel frame.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figures 1, 2:
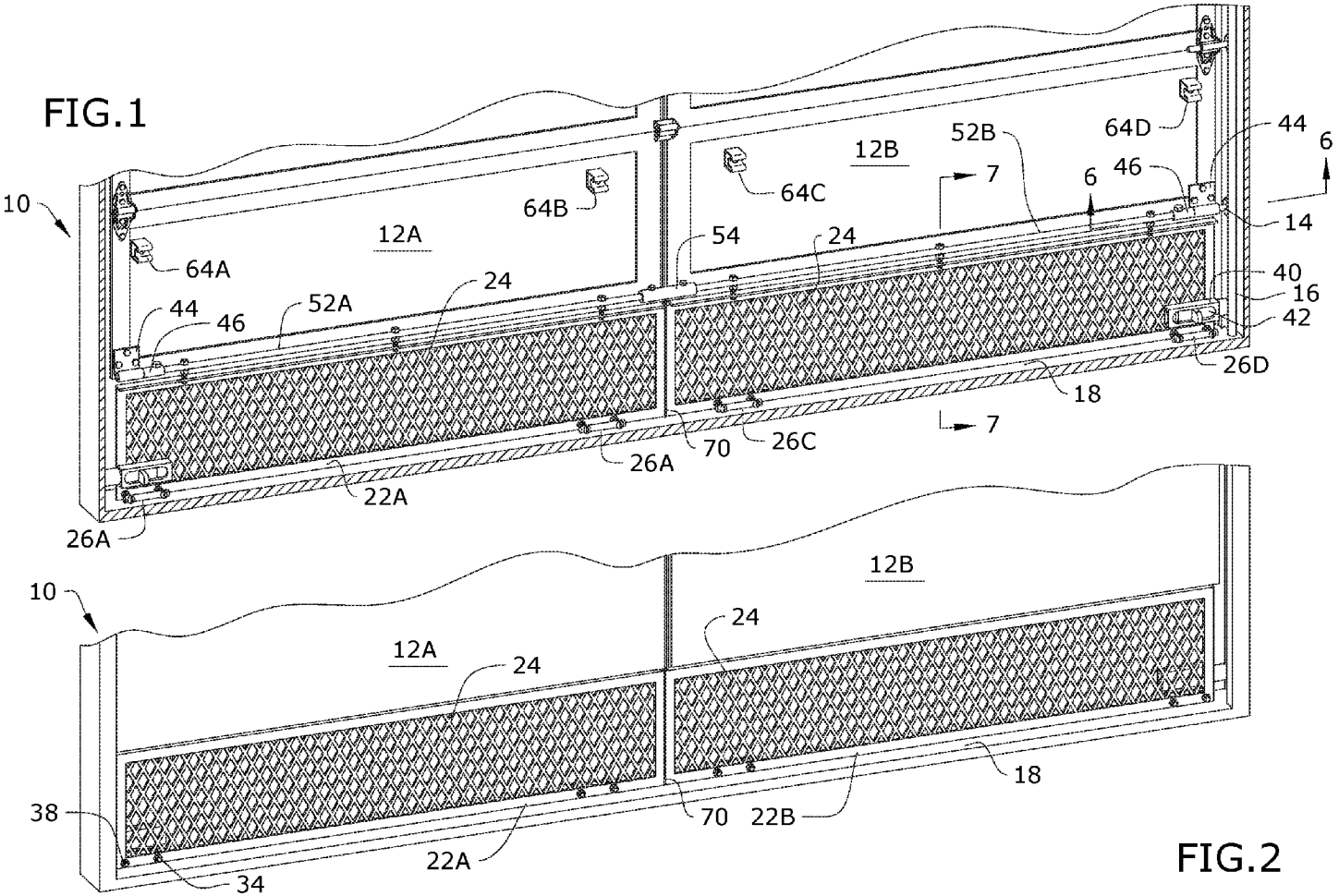
FIG. 1 shows an interior perspective view of one embodiment of the present invention.
FIG. 2 shows an exterior perspective view of one embodiment of the present invention.

By way of example, and referring to FIG. 1, garage door 10 further comprises garage door panels 12 which are attached to garage door wheels 14. Garage door wheels 14 slide along garage door rail 16. A system (not shown) raises and lowers garage door panels 12 from a ground surface 18.

Garage door accessory 20 further comprises panel frame 22 attached to panel grate 24. Panel frame 22 is further attached to stow bar 26 with first screw 28 and second screw 30. First screw 28 is attached to panel frame 22 with first screw interior nut 32 and first screw exterior nut 34. Similarly, second screw 30 is attached to panel frame 22 with second screw interior nut 36 and second screw exterior nut 38.

Figure 3:
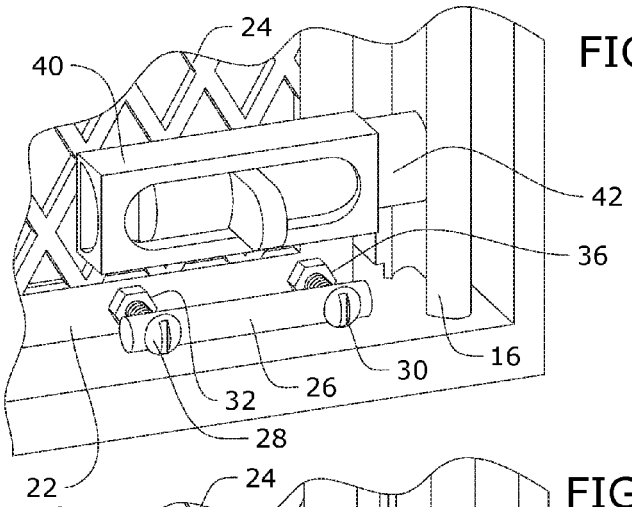
FIG. 3 shows an interior detailed perspective view of one embodiment of the present invention.
Figure 4:
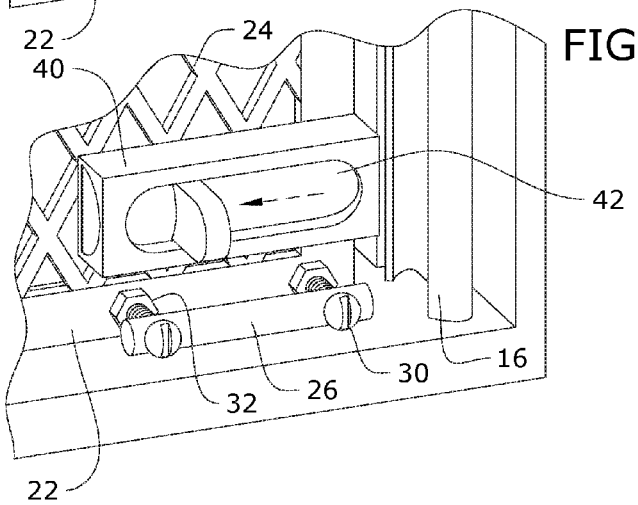
FIG. 4 shows an interior detailed perspective view of one embodiment of the present invention.

Panel grate 24 is further attached to lock assembly 40. Lock assembly 40 further comprises lock bar 42. To operate lock bar 42, as shown in FIG. 3 and FIG. 4, a user simply slides lock bar 42 behind garage door rail 16.

Garage door 10 is attached to garage wheel bracket 44. Garage wheel bracket 44 is attached to garage door wheel axle 46 which terminates in garage door wheel 14. Extension 48 is attached to garage door wheel axle 46 with extension fastener 50. Extension 48 is further connected to first hinge bar 52A. First hinge bar 52A is joined to bar bracket 54 with first hinge bar fastener 56A. Second hinge bar 52B is joined to bar bracket 54 with second hinge bar fastener 56B.

Figure 7:
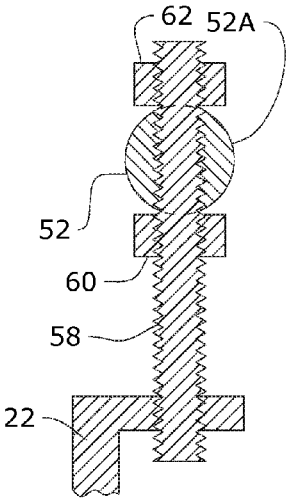
FIG. 7 shows a detail section view of one embodiment of the present invention along line 7-7 in FIG. 1.
Figure 5:
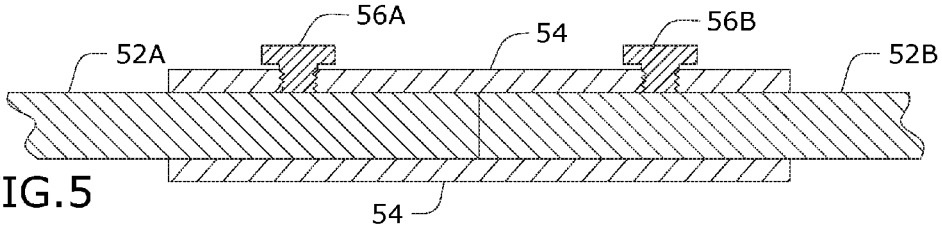
FIG. 5 shows a detail section view of one embodiment of the present invention along line 5-5 in FIG. 1.
Figure 6:
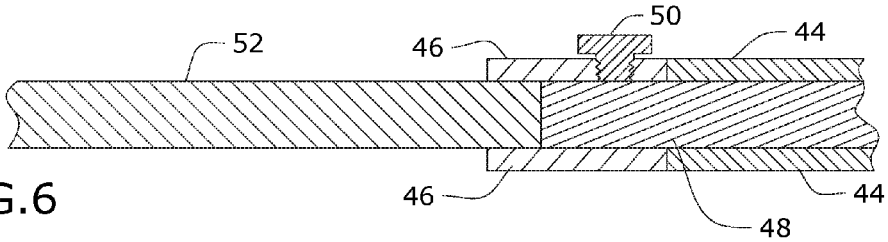
FIG. 6 shows a detail section view of one embodiment of the present invention.
Figure 8:
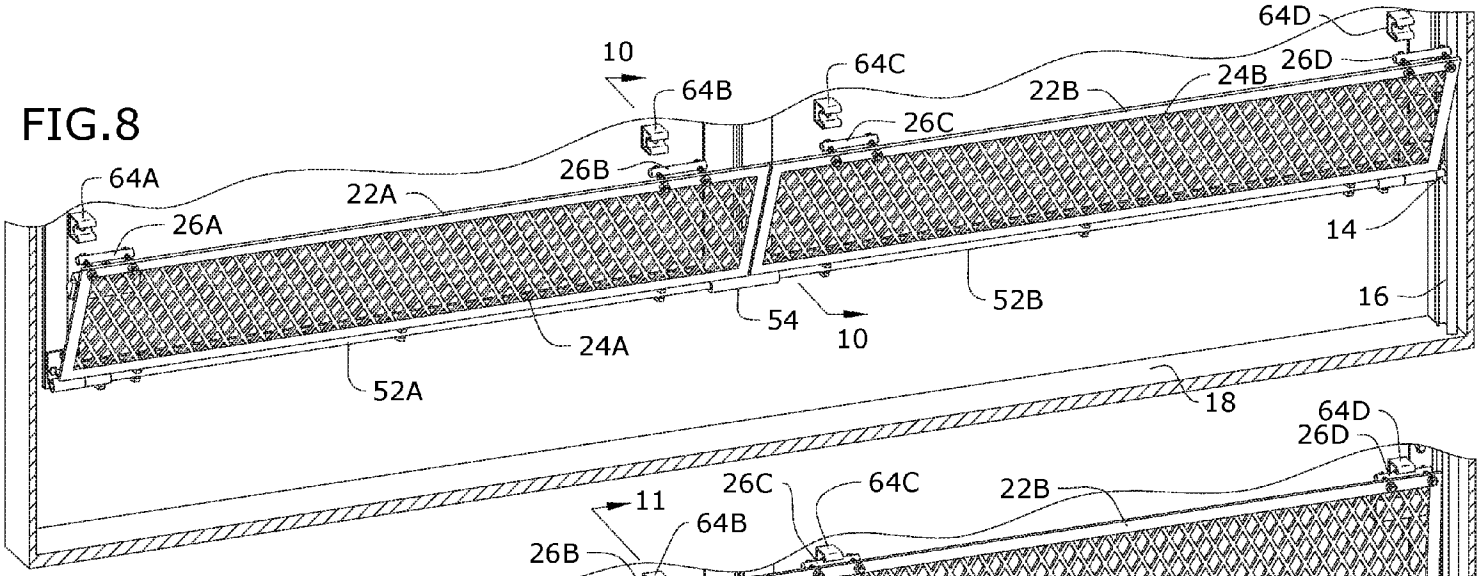
FIG. 8 shows an interior perspective view of one embodiment of the present invention.
Figure 9:
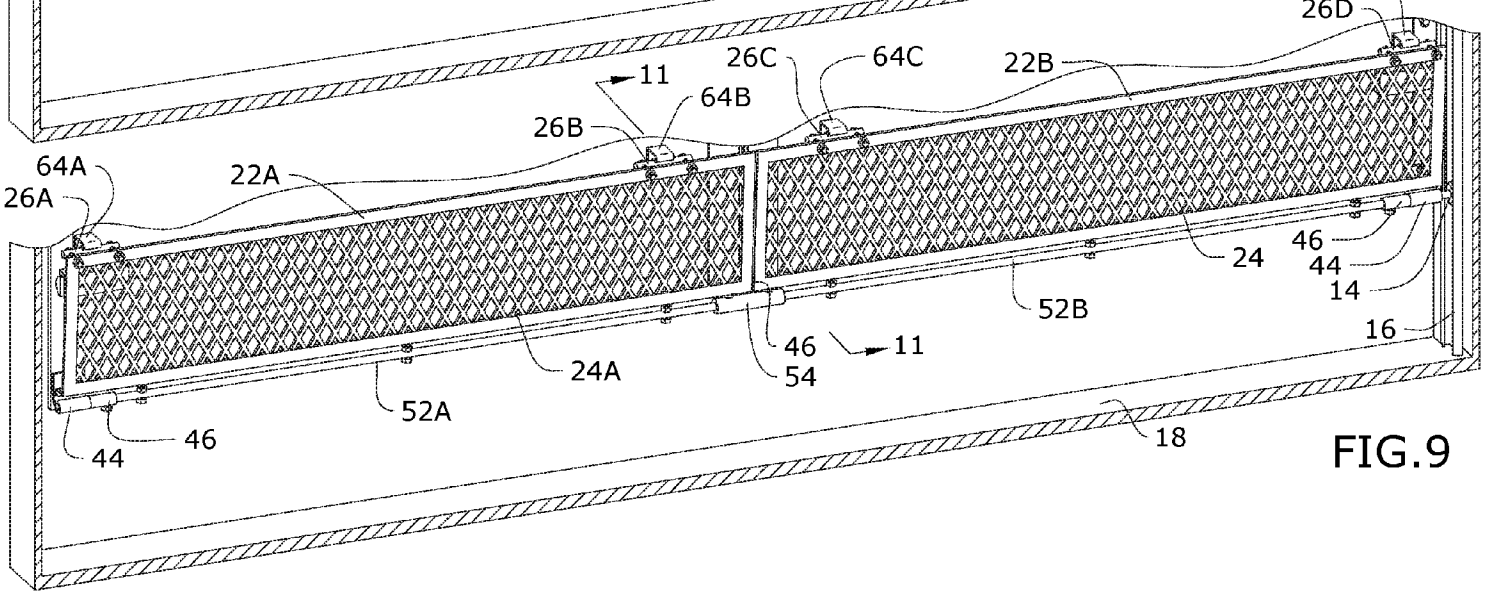
FIG. 9 shows an interior perspective view of one embodiment of the present invention.
Figure 10:
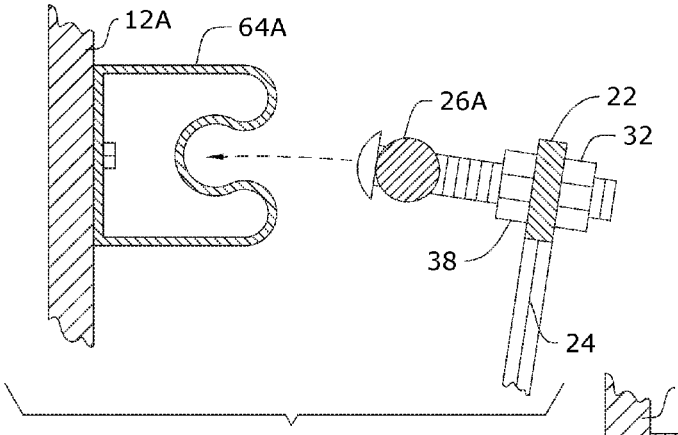
FIG. 10 shows a detail section view of one embodiment of the present invention along line 10-10 in FIG. 8.
Figure 11:
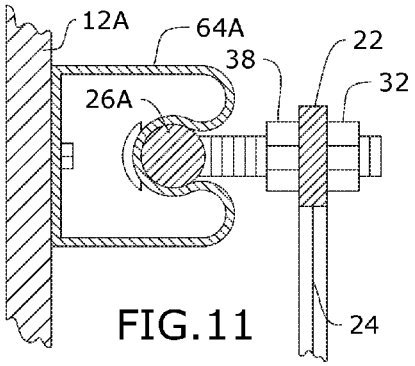
FIG. 11 shows a detail section view of one embodiment of the present invention along line 11-11 in FIG. 9.

Turning to FIG. 7, in some embodiments, it may be desirable to maneuver a lower edge of panel frame 22 proximate or distant the ground surface 18. To accomplish this, panel frame 22 is attached to threaded rod 58. Threaded rod 58 travels through a pathway in first hinge bar 52A and is attached to first hinge bar 52A with lower adjustment fastener 60 and upper adjustment fastener 62. For instance, lower adjustment fastener 60 can be loosened and upper adjustment fastener 62 can be tightened to move the lower edge of panel frame 22 proximate the ground surface 18. Alternately, lower adjustment fastener 60 can be tightened and upper adjustment fastener 62 can be loosened to move the lower edge of panel frame 22 proximate the ground surface 18.

As shown in FIG. 1, first panel 12A can be attached to first panel frame first stow bracket 64A and first panel frame second stow bracket 64B. First panel frame 22A can be attached to first panel first stow bar 26A and first panel second stow bar 26B. Turning to FIGS. 8-11, when first panel frame 22A is rotated upward, first panel frame first stow bracket 64A joins with first panel first stow bar 26A and first panel frame second stow bracket 64B joins with first panel second stow bar 26B to put garage door accessory 20A in a stowed position.

Additionally, second panel 12B can be attached to second panel frame first stow bracket 64C and second panel frame second stow bracket 64D. Second panel frame 22B can be attached to second panel first stow bar 26C and second panel second stow bar 26D. Turning to FIGS. 8-11, when second panel frame 22B is rotated upward, second panel frame first stow bracket 64C joins with second panel first stow bar 26C and second panel frame second stow bracket 64D joins with second panel second stow bar 26D to put garage door accessory 20B in a stowed position.

Figure 12:
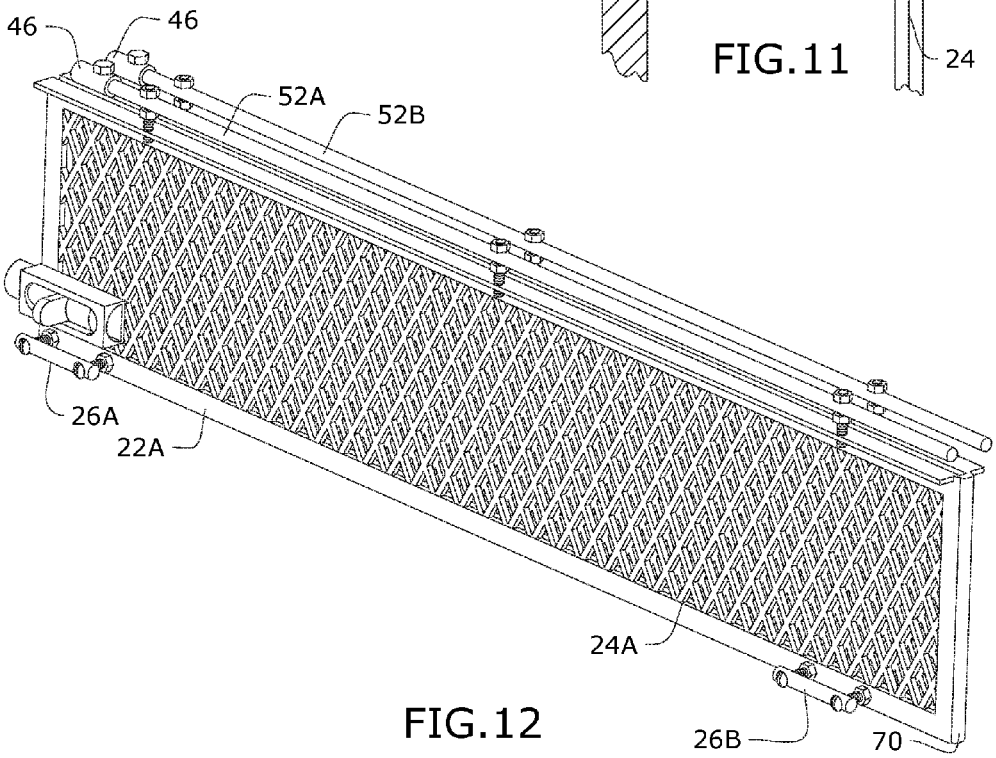
FIG. 12 shows a perspective view of one embodiment of the present invention.

Turning to FIG. 12, one advantage of the current system is that it is easy to remove and stow. Hinge 70 is attached to first panel frame 22A and second panel frame 22B such that first panel frame 22A can be folded against second panel frame 22B.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. §112, ¶6. In particular, any use of "step of" in the claims is not intended to invoke the provision of 35 U.S.C. §112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A garage door accessory, configured to increase ventilation into a garage; the garage door accessory comprising:

at least one panel frame attached to at least one panel grate;

at least one stow bar attached to the panel frame;

a lock assembly attached to the panel grate and the panel frame; wherein the lock assembly further comprises a lock bar;

a threaded rod, operatively joined to the at least one panel frame; wherein the threaded rod is fit through a first hinge bar and attached to the first hinge bar with a lower adjustment fastener and an upper adjustment fastener;

a bar bracket, attached to the first hinge bar and a second hinge bar;

an extension, attached to a garage door wheel axle and the first hinge bar;

a garage wheel bracket, attached to the garage door wheel axle; and a garage door wheel, attached to a distal end of the garage door wheel axle.

2. The garage door accessory of claim 1, further comprising: a stow bar attached to the at least one panel frame.

3. The garage door accessory of claim 2, wherein the at least one panel frame further comprises a first panel frame and a second panel frame;

a hinge, attached to the first panel frame and the second panel frame wherein the first panel frame can be folded against the second panel frame.

* * * * *